United States Patent [19]

Isobe et al.

[11] Patent Number: 4,799,310

[45] Date of Patent: Jan. 24, 1989

[54] METHOD FOR MANUFACTURING A BAR ANTENNA

[76] Inventors: Atsushi Isobe, Kopofurukawa 102, 17-13, Haneda 3-chome, Ota-ku, Tokyo 144; Masahiko Isobe, Sakuraiso, 6306 Tsujido, Fujisawa-shi, Kanagawa 251; Naoki Isobe, 27-11, Haneda 5-chome, Ota-ku, Tokyo 144, all of Japan

[21] Appl. No.: 15,372

[22] PCT Filed: May 10, 1985

[86] PCT No.: PCT/JP85/00262

§ 371 Date: Dec. 30, 1986

§ 102(e) Date: Dec. 30, 1986

[87] PCT Pub. No.: WO86/06868

PCT Pub. Date: Nov. 20, 1986

[51] Int. Cl.[4] ..... H01F 41/06

[52] U.S. Cl. ..... 29/605; 29/606; 242/7.03; 242/7.11; 336/213; 336/234; 343/788

[58] Field of Search ..... 336/220, 221, 213, 234; 343/788; 29/605, 602 R, 606; 242/7.03, 7.11

[56] References Cited

U.S. PATENT DOCUMENTS 4,270,128 5/1981 Drewett ..... 343/788 X

*Primary Examiner*—Carl E. Hall

*Attorney, Agent, or Firm*—Jordan and Hamburg

[57] ABSTRACT

A method of manufacturing a bar antenna having a magnetic core incorporated therein includes removing a covering material from each end portion of parallel covered cords, the parallel covered cords being separated from each other by a length required for winding on the magnetic core, the portions wherefrom the covering material is removed being connected together. A winding start position is set beforehand so that an end portion of the magnetic core can be matched in position with the winding end of a coil. One cord, a connecting portion and the other cord are wound in sequence consecutively from the start position to the end portion of the magnetic core, starting from the base of the separated portions of the cords, so as to form the coil, and thereafter the coil thus formed is transferred to a prescribed position, while the portions of the parallel covered cords not separated from each other are used as an extension cord as they are.

12 Claims, 4 Drawing Sheets

METHOD FOR MANUFACTURING A BAR ANTENNA

TECHNICAL FIELD

This invention relates to a method for manufacturing a bar antenna wherein parallel cords coated with vinyl or the like are used as extended and parallel lead wires of conventional cords so as to facilitate the manufacture thereof and to improve the performance, external appearance and feeling of touch thereof, and it is fitted to be used as coils for a bar antenna, a loop antenna and a pickup coil, as well as for a transformer, an electromagnet, etc., wherein they are wound in a relatively short length.

BACKGROUND ART

Coils are used extensively for the bar antenna, the loop antenna and the pickup coil, as well as for the transformer, the electromagnet, etc. The coils used for these appliances are generally connected thereto with a terminal provided at the end of the lead wire of each coil, or by soldering the extension of the coil thereto.

For some years, on the other hand, transition from "analog" to "digital" is seen in designs of audio sets such as radios, cassette tape recorders with radios, amplifiers and tuners, and of television sets, and an advance is made therewith in making them small in size and in improving the performance thereof. Owing to the enlargement of a pulse waveform resulting from digitization, however, noise increases in each set of the above-mentioned appliances, and thus it turns necessary to keep an antenna apart from the set and connect it to the latter by an extension cord or the like for improving an S/N ratio (signal/noise ratio). In other words, an antenna with an extension cord is necessitated.

A method of manufacturing a bar antenna will be described hereunder for exemplifying a coil usually manufactured. A conventional bar antenna is prepared by inserting a ferrite core 2 through a paper tube 1 as shown in FIG. 6, and a covered copper wire 3 is wound round on the paper tube 1. Moreover, a coil-fixing adhesive 4 is applied thereon so as to prevent a coil thus formed from getting loose. The coil for which the paper tube is used is subjected beforehand to a moisture resistance treatment with wax or the like. Subsequently the end of a cord 5 and the end of a lead wire 6 of the covered copper wire 3 of the coil are twisted together at a connecting portion 7 and soldered, and then they are fixed temporarily with a tape or the like put thereon. In a process just before a case 9 is fitted, an adhesive is applied for fixation.

As described above, the conventional method has faults that it requires much labor and time because of a large number of manufacturing processes it needs, and that breakage of the connecting portion 7, loosening of the coil or the like occurs when strong pulling of the cord 5 or any other similar matter takes place, which results in the lowering of a yield of manufacture.

Moreover, with respect to the structure, it is necessary to prepare an extension cord 5 by soldering a covered cord with the lead wire 6 for employing the antenna outside the set, since the lead wire 6 may not be extended to the outside of the set. Extension of the lead wire 6 in an exposed state to the outside means to expose outside a bare member which is naturally to be housed in the case 9, and this is disadvantageous in design of a commodity for external appearance, feeling of touch, performance, etc., thereof.

DISCLOSURE OF INVENTION

A method of manufacturing a bar antenna according to the present invention involves utilizing with a cord to enable a simple manufacture of the coil with the cord by using the parallel covered cords in such a manner that a covering material on each one end portion of the parallel covered cords is removed, the portions wherefrom said covering material is removed are connected together, the portions of the parallel covered cords to be wound are separated to make a coil; and the portions of the cords which are not separated from each other are used as an extension cord as they are.

A coil of a large number of turns could not be formed, in some cases, of a vinyl-coated cord or the . like in the past. With a recent progress in technologies (progress in design of radios, tuners, etc.), in contrast, coils need not have such a large number of turns as in the past. The number of turns of a bar antenna for an LW-MW-SW band, for instance, is about ten. Accordingly, even a somewhat thick cord can be used now for a coil.

BEST MODE FOR CARRYING OUT THE INVENTION

Figure 1:
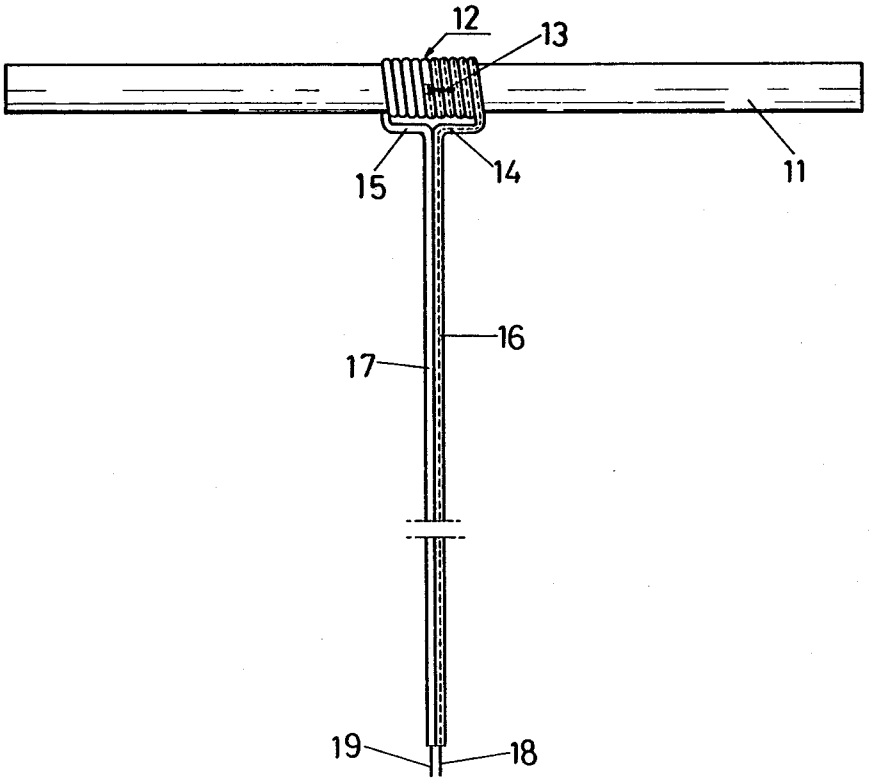
FIG. 1 is a front view of a coil with a cord according to this invention.
Figure 4:
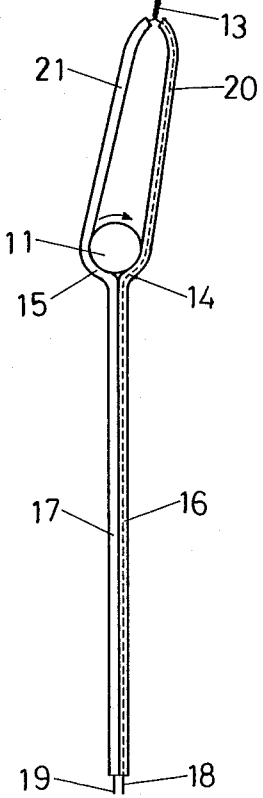
FIGS. 2 to 4 are front views showing processes of manufacture of the coil with the cord disclosed in this invention.
Figure 3:
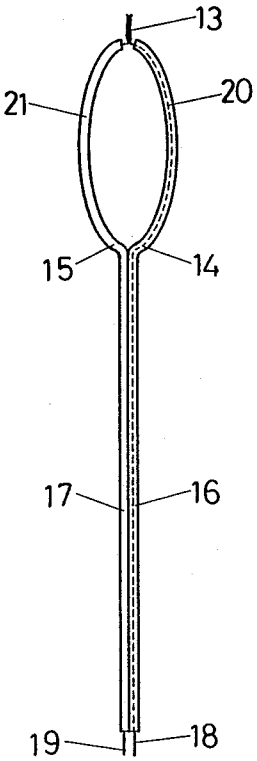
Figure 2:
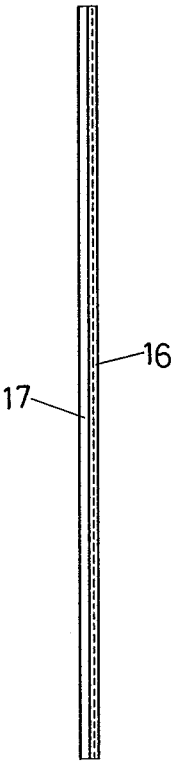

Next, one embodiment of a coil with a cord disclosed in this invention will be described with reference to FIG. 1. Numeral 11 denotes a ferrite core, and the outer periphery of the core 11 is surrounded beforehand by a cellophane tape (or a heat-shrinkable tube or the like). Numeral 12 denotes a coil, and in an illustration of the figure, the number of turns thereof is ten. Numeral 13 denotes a connected cord-end portion, 14 and 15 lead wire portions, and 16 and 17 cords. The length of the cords 16 and 17 may be set appropriately as occasion arises, and it is one meter in this illustration. Numeral 18 and 19 denote cord-end core wire portions, and the cord ends are separated in some cases from each other and provided with connection terminals such as arrow-shaped terminals or plugs respectively, though they are not shown in the figure. Both the coil 12 and the lead wire portions 14 and 15 consist of vinyl-coated cords, and the lead wire portions 14 and 15 are integrated with the parallel cords 16 and 17. As for a material for covering the cords, polyethylene, rubber or a rubber-coated fabric tape, for instance, may be used other than vinyl. In short, a cord having any quality and structure may be used without limitation to the above, on condition that it has such performance as enabling the employment thereof as it is as a coil and a cord.

Figure 5:
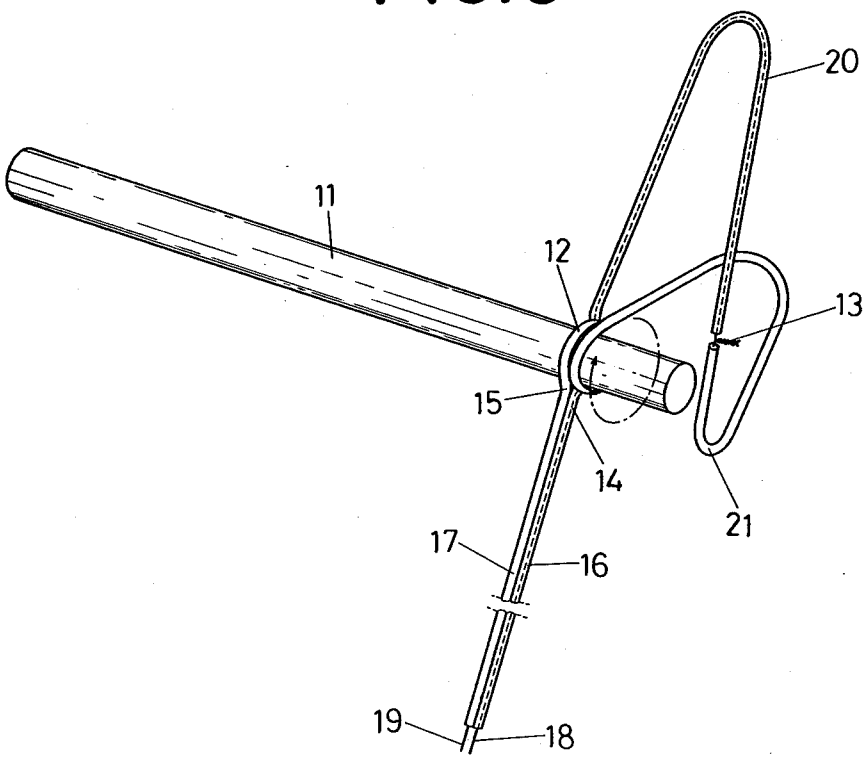
FIG. 5 is a perspective view showing a process of manufacture of the coil with the cord according to this invention.
Figure 6:
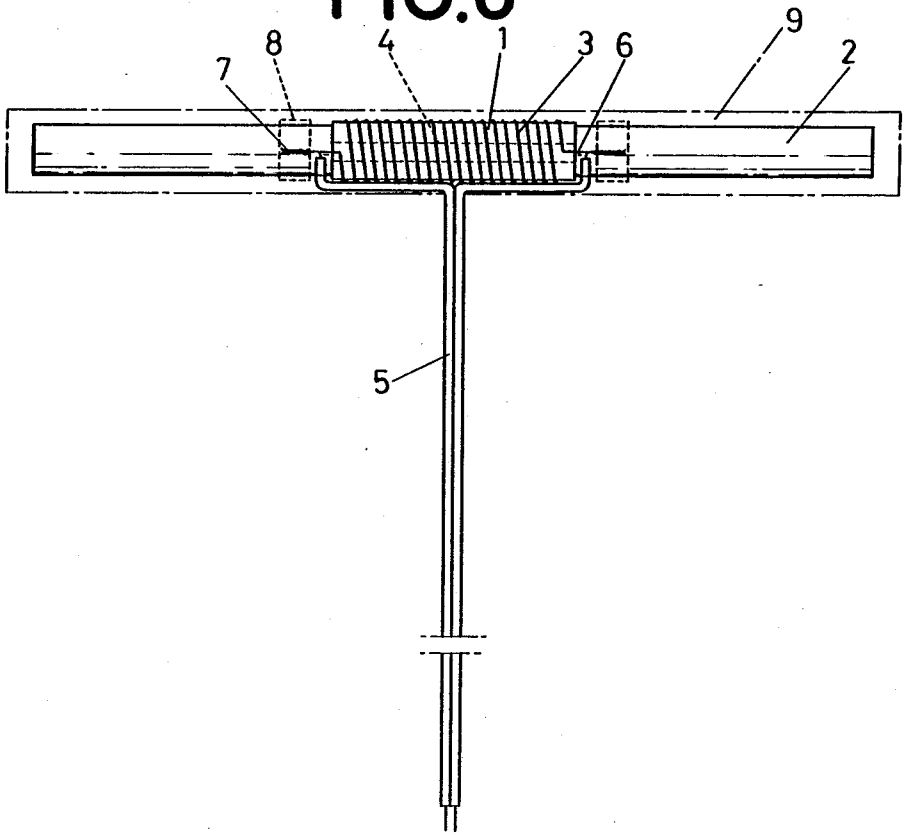
FIG. 6 is a front view of a conventional example.

Next, one embodiment of a manufacturing method of a coil with a cord according to this invention will be described with reference to FIGS. 2 to 5. A covering material on the opposite end portions of parallel vinyl-coated cords 16 and 17 is removed, and the respective end portions on one side thereof are separated into separated cords 20 and 21 of a length required to be wound on a core 11. Then, the ends of these two separated cords 20 and 21 are connected together to make a connected cord-end portion 13. In the course down to this process, any of the abovedescribed manufacturing operations may forego. Next, the cords are wound after a winding start position is set so that the right end of the core 11 may be matched in position with the winding end of a coil, as shown in FIG. 5. An arrow in the figure shows the state of the winding which is started from the separated cord 21, and the necessary number of turns is completed by winding the remaining separated cord 20. Then, a coil 12 thus formed is moved to a prescribed position (to the center of the core 11 in the illustration of FIG. 1). By this method, the length of the lead wire portions 14 and 15 can be minimized. The parallel vinyl-coated cords 16 and 17 which are not separated, on the other hand, are used as extension cords as they are. While the parallel vinyl-coated cords are employed in the example described above, cords to be used are not limited to them, and any cords may be employed on condition that they have such performance as enabling them to be used as extension cords while functioning as a coil. Parallel coated cords bearing polarity marks, such as those illustrated in the figures, are convenient for employment, since the polarity of a cord can be seen by eye. Cords to be employed may be selected in accordance with their use, since cords having no polarity marks are preferable, in some cases, according to the use thereof. In addition, a cord to be employed can be selected arbitrarily from a double-core cord, a multi-core cord and a stranded multi-core cord according to the use.

While a bar antenna is cited in the above embodiment, this invention produces a large effect also with regard to a loop antenna, a pickup coil, a transformer, a motor, etc., in which a coil relatively small in winding length is used.

Industrial Applicability

According to the manufacturing method of the present invention, the same covered cord is used for the coil and the cord. This simplifies the manufacture, improves the performance, enables the extensive employment for a coil requiring a longish cord, and is useful particularly for appliances in which a cord is exposed to the outside in employment and therefore much importance is attached to the performance including the external appearance and the feeling of touch. Since the coil and the cord are integrated, moreover, a conventional connecting portion of the coil end with the cord can be dispensed with, which improves the performance related with a shock of dropping, as well as a yield of manufacture, and enlarges the field of employment. In addition the cellophane tape (or the heat-shrinkable vinyl tube or the like) put on the outer periphery of the ferrite core, which is mentioned in the description of the above embodiment, is very useful for making smooth the transfer of the coil after the winding process is completed, and also for preventing such a serious fault as breakaway of the core which is caused by the break thereof due to the shock of dropping.

What is claimed is:

1. A method of manufacturing a bar antenna having a magnetic core incorporated therein, characterized in that a covering material on each one end portion of parallel covered cords is removed, the parallel covered cords are separated from each other by a length required for winding on a magnetic core, the portions wherefrom said covering material is removed are connected together, a winding start position is set beforehand so that an end portion of the magnetic core can be matched in position with the winding end of a coil, one cord, a connecting portion and the other cord are wound in this sequence consecutively from said start position to the end portion of the magnetic core, starting from the base of the separated portions of the cords, so as to form the coil, and thereafter the coil thus formed is transferred to a prescribed position, while the portions of the parallel covered cords not separated from each other are used as an extension cord as they are.

2. A method of manufacturing a bar antenna having a magnetic core incorporated therein according to claim 1 in which a covering material is vinyl.

3. A method of manufacturing a bar antenna having a magnetic core incorporated therein according to claim 1 in which the covering material is rubber.

4. A method of manufacturing a bar antenna having a magnetic core incorporated therein according to claim 1 in which the covering material is polyethylene.

5. A method of manufacturing a bar antenna having a magnetic core incorporated therein according to claim 1 in which the covering material is a rubber-coated fabric tape.

6. A method of manufacturing a bar antenna having a magnetic core incorporated therein according to claim 1 in which parallel covered cords are double-core cords.

7. A method of manufacturing a bar antenna having a magnetic core incorporated therein according to claim 1 in which the parallel covered cords are multicore cords.

8. A method of manufacturing a bar antenna having a magnetic core incorporated therein according to claim 1 in which the parallel covered cords are stranded multi-core cords.

9. A method of manufacturing a bar antenna having a magnetic core incorporated therein according to claim 1 in which the parallel covered cords are cords with polarity marks.

10. A method of manufacturing a bar antenna having a magnetic core incorporated therein according to claim 1 in which the parallel covered cords are cords without polarity marks.

11. A method of manufacturing a bar antenna having a magnetic core incorporated therein according to claim 1 in which a connection terminal is provided at the end on the extension cord side of each parallel covered cord.

12. A method of manufacturing a bar antenna having a magnetic core incorporated therein according to claim 1 in which a plug is provided at the end on the extension cord side of each parallel covered cords.

* * * * *